US007683869B2

(12) United States Patent
Shen et al.

(10) Patent No.: US 7,683,869 B2
(45) Date of Patent: Mar. 23, 2010

(54) DRIVE METHOD FOR DISPLAY OF GRID ARRAY PIXELS

(75) Inventors: Yuh-Ren Shen, Tainan (TW); Chang-Cheng Li, Taipei (TW); Yu-Lin Lee, Taipei (TW)

(73) Assignee: VastView Technology, Inc. (TW)

( * ) Notice: Subject to any disclaimer, the term of this patent is extended or adjusted under 35 U.S.C. 154(b) by 1311 days.

(21) Appl. No.: 11/155,681

(22) Filed: Jun. 20, 2005

(65) Prior Publication Data

US 2006/0284897 A1 Dec. 21, 2006

(51) Int. Cl.
*G09G 3/36* (2006.01)

(52) U.S. Cl. ..... 345/89; 348/563

(58) Field of Classification Search ..... 345/87–89; 348/563–566

See application file for complete search history.

(56) References Cited

U.S. PATENT DOCUMENTS 5,774,101 A * 6/1998 Hirai et al. ..... 345/89
6,359,389 B1 * 3/2002 Medina et al. ..... 315/169.1
7,012,591 B2 * 3/2006 Chen et al. ..... 345/88
2002/0011979 A1 * 1/2002 Nitta et al. ..... 345/89
2002/0163490 A1 * 11/2002 Nose ..... 345/89

* cited by examiner

*Primary Examiner*—Richard Hjerpe
*Assistant Examiner*—Kimnhung Nguyen
(74) *Attorney, Agent, or Firm*—Lowe Hauptman Ham & Berner, LLP

(57) ABSTRACT

A method to drive a display with grid array pixels is comprised of writing image data containing a range of grayscale code into multiple pixels; at least a time of a pixel row being divided into frame time and black picture time; each code in the grayscale range being mapped to that in and adjusted range to drive the display without changing gamma voltage or with increased gamma voltage of the greatest grayscale code to present the luminance desired; pixel response time being shorter than frame time; and black picture data being written into the pixel row during the black picture time.

7 Claims, 10 Drawing Sheets

DRIVE METHOD FOR DISPLAY OF GRID ARRAY PIXELS

BACKGROUND OF THE INVENTION (a) Field of the Invention

The present invention is related to a method to drive a display of grid array pixels, and more particularly to one that has grayscale code range of each light color mapped to an adjusted range and to overdrive pixels to present the luminance desired for the response time of the pixel to be shorter than the frame time, thus to solve the problem of residual image.

(b) Description of the Prior Art

Reason for LCD to get popular is that in comparison with the conventional CRT display, LCD provides advantage of low power consumption, compact, radiation free and absence of glittering to make it applicable to TV, notebook or PC screen and gradually becomes the mainstream in the manufacturing industry of display. Furthermore, with the advancing process technology of display and the introduction of large size LCD, LCDs become even more comprehensively applied in daily life and A/V entertainment. Meanwhile, more demands are particularly put on the visual angle, response speed and number of colors of the display to pursue even higher quality presentation of image of the display.

Conventional CRT display works on having electronic beams to irradiate from the terminal of a vacuum tube to a screen coated with light emitting material; the irradiated screen produces momentary colors, meaning they will disappear before the irradiation of the image data of the next picture. That type of display refers to impulse type, and there will be no residual image between pictures; however, glittering does exist if the scanning frequency of the CRT display is not fast enough.

On the contrary, there will be no problem of glittering in case of a LCD because LCD contains a liquid crystal capacitor $C_{LC}$ and storage capacity ($C_S$) so that the voltage to drive liquid crystal molecules is stored in a fully charged capacitor to be held for the next updated picture. This type of display is referred to as a hold type. However, if the response rate of liquid crystal molecules when driven by the voltage is not fast enough, i.e., the response time is greater than the frame time, the picture will become blur or produce residual image to significantly affect the viewing quality.

As illustrated in FIGS. 1, 2A, and 2B, generally the response time is divided into two parts: (1) Rising response time ($T_r$): i.e., with the applied voltage, the time raising taken for the luminance of the liquid crystal box of the LCD to change from the level of 10% up to 90%; and (2) Falling response time ($T_f$), i.e., without the applied voltage, the time falling taken for the luminance of the liquid crystal box to change from the level of 90% down to 10%. If the curve of the variation of the normal luminance is indicated as "10" for a display to receive the image of code A during the first frame time I and the image of code B during the second frame time II, the expected luminance of code B may be achieved only upon entering into the firth frame time III in case of a display with the response rate of its liquid crystal molecules. Furthermore, if the display relates to a hold type, problems of deferred or residual image will appear as illustrated in FIG. 2B, wherein, the arrow points out the scanning direction of the display. If overdrive method is used to have the second frame time II of the display to drive with and OD voltage higher than that of code B and the response rate of the liquid crystal molecules is fast enough, the luminance variation may reach the expected luminance with that frame time with its luminance curve as that marked by 10'. Even so, certain residual image problem remains in case of a hold type display with its scanning picture as illustrated in FIG. 2B.

To solve the problem of residual image, the impulse type of CRT display is usually borrowed in the following two approaches: (1) Data of black color or black pictures are inserted into pictures of continuous images; and (2) Signals of black picture are inserted into back light source to control the light source for producing flaring effects so to glitter the back light source. As illustrated in FIGS. 3A when the first approach is applied to insert black pictures into picture of image, the grayscale code of the image of the first frame time I is code A, data of black picture are received upon entering into the first black picture time I' for the luminance variation curve 20 to indicate as an impulse curve. Upon entering into the second frame time II, the third frame time III and the fourth frame time IV, code B with a luminance higher than that of code A is received while data of black pictures will immediately following after each grayscale code B, e.g., the second black picture time II', the third black picture time III' and the fourth black picture time IV'. Theoretically, any pixel driven by code B shall give the same luminance performance, i.e., the highest points of the luminance curve shall be at the same level. However, lab test shows that the luminance is gradually rising with the luminance of any frame time higher than that of the immediately preceding one, a phenomenon so far not yet explained by any theory in the field of liquid crystal. As projected, the sticking characteristic of liquid crystal molecules might be attributable to such phenomenon. Nonetheless, the problem should be solved to avoid poor picture quality or insufficient luminance of the picture to indicate the delay as illustrated in FIG. 3B.

SUMMARY OF THE INVENTION

The primary purpose of the present invention is to provide a drive method for a display of grid array pixels by mapping the original grayscale range to an adjusted range without changing the corresponding gamma voltage, and overdriving the pixels of the display to insert data of black picture into where between frame times for the response time to be shorter than the frame time, thus to upgrade the picture quality.

Another purpose of the present invention is to provide a drive method for a display of grid array pixels by judging whether the image relates to dynamic or still picture through image comparison module for the display to determine whether OD method will be used to shorten the response time.

To achieve those aforesaid purposes of the present invention, the procedure of the present invention includes having image data provided with a grayscale code range into an adjusted range containing multiple grayscale codes wherein a time of at least one pixel row is divided into frame time and black picture time; then mapping the grayscale code of each color light to the adjusted range by retaining a constant gamma voltage or increasing the gamma voltage corresponding to the greatest grayscale code, thus to overdrive pixels to present the luminance desired for the current image by making the pixel response time to become shorter than the frame time while writing the black picture data into that pixel row. Wherein, frame rate control or dithering technology is used in the course of applying the code mapping technology to avoid loss of grayscale code.

The drive method of the present invention may have the image data to be inputted to an image comparison module of the display so to judge wither the image is related to a still or dynamic picture. If for the latter, all the grayscale codes of each color light of the display are mapped to a smaller range and to overdrive at least one pixel row to present the luminance desired by the current image and/or write a black picture data into at least one pixel row of the display.

DETAILED DESCRIPTION OF THE PREFERRED EMBODIMENTS

Figure 1:
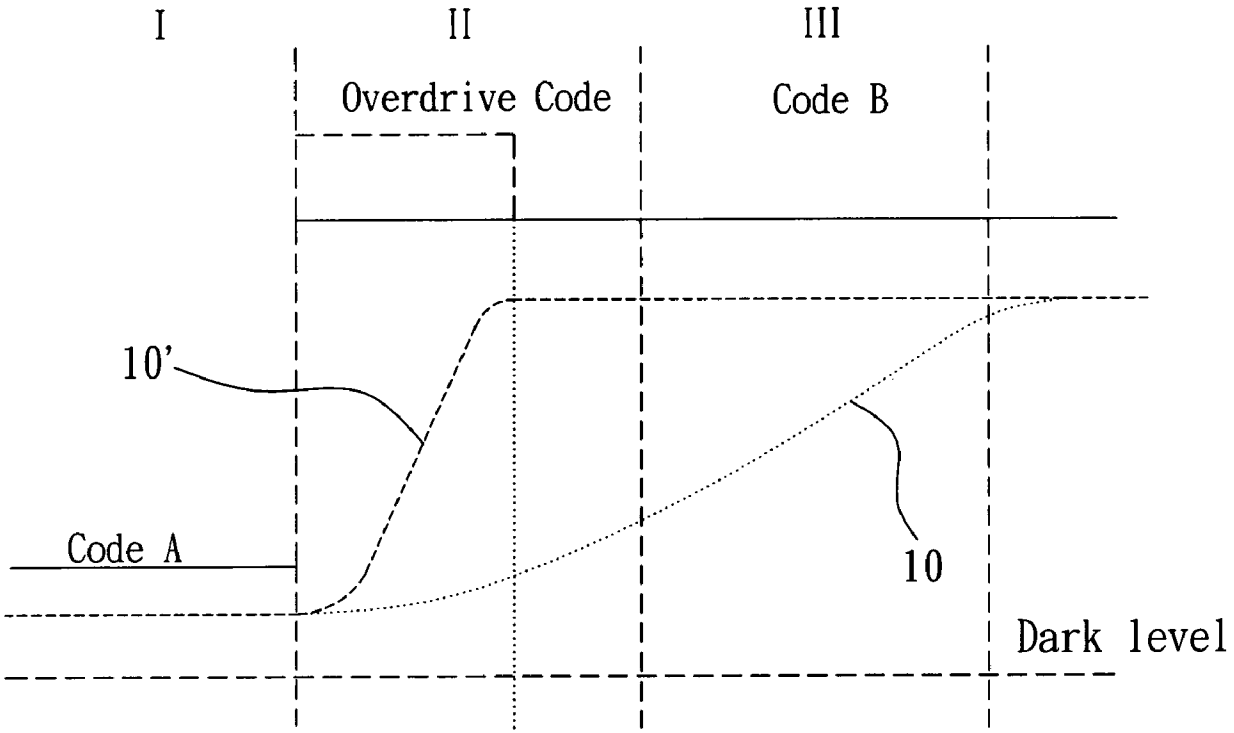
FIG. 1 (PRIOR ART)
FIG. 1 is a schematic view showing a luminance curve of a display when overdriven.
Figure 2B:
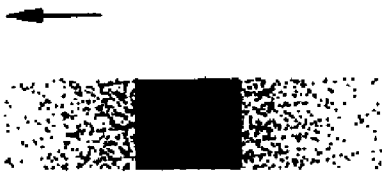
FIG. 2B (PRIOR ART)
FIG. 2B is another schematic view showing a picture display of a hold type display when the response rate of the liquid crystal molecule is not fast enough.
Figure 2A:
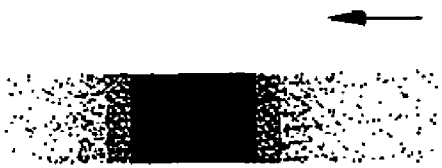
FIG. 2A (PRIOR ART)
FIG. 2A is a schematic view showing a picture display of a hold type display when the response rate of the liquid crystal molecule is not fast enough.
Figure 3B:
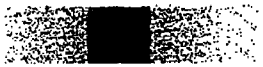
FIG. 3B (PRIOR ART)
FIG. 3B is a schematic view showing a picture display of a display applied with the pseudo impulsive technology when the response rate of the liquid crystal molecule is not fast enough.
Figure 3A:
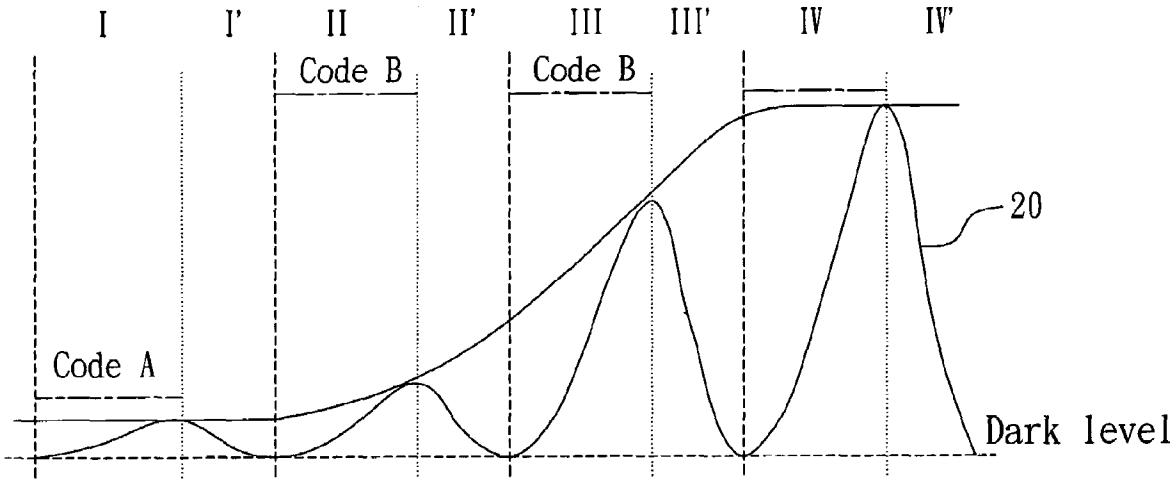
FIG. 3A (PRIOR ART)
FIG. 3A is a schematic view showing the curve of the luminance when applied with voltage using the pseudo impulsive technology to an LCD.
Figures 4A, 4B:
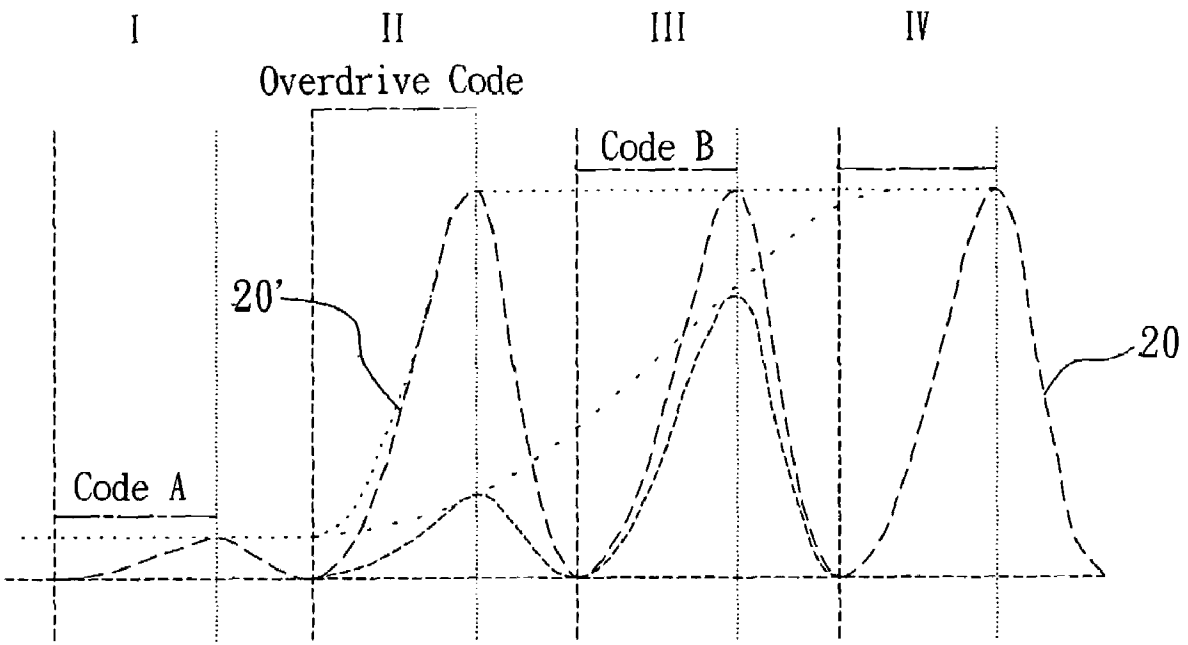
FIG. 4A is a schematic view showing the variation of luminance of an LCD when applied with voltage using the pseudo impulsive technology and overdrive method.
FIG. 4B is a schematic view showing a picture display of the display illustrated in FIG. 4A.

Referring to FIGS. 4A and 4B, to eliminate the problem of gradually increasing luminance as illustrated in FIG. 3A, the drive method for an display of the present invention involves giving an overdrive grayscale code that is greater than code B to the pixel of the display for the luminance curve to be promoted from luminance of code A to that as desired by code B with a luminance curve as that marked by 20'. Upon reaching the expected luminance, code B continuously to drive the display to avail the clear and consistent picture as illustrated in FIG. 4B.

Figure 5:
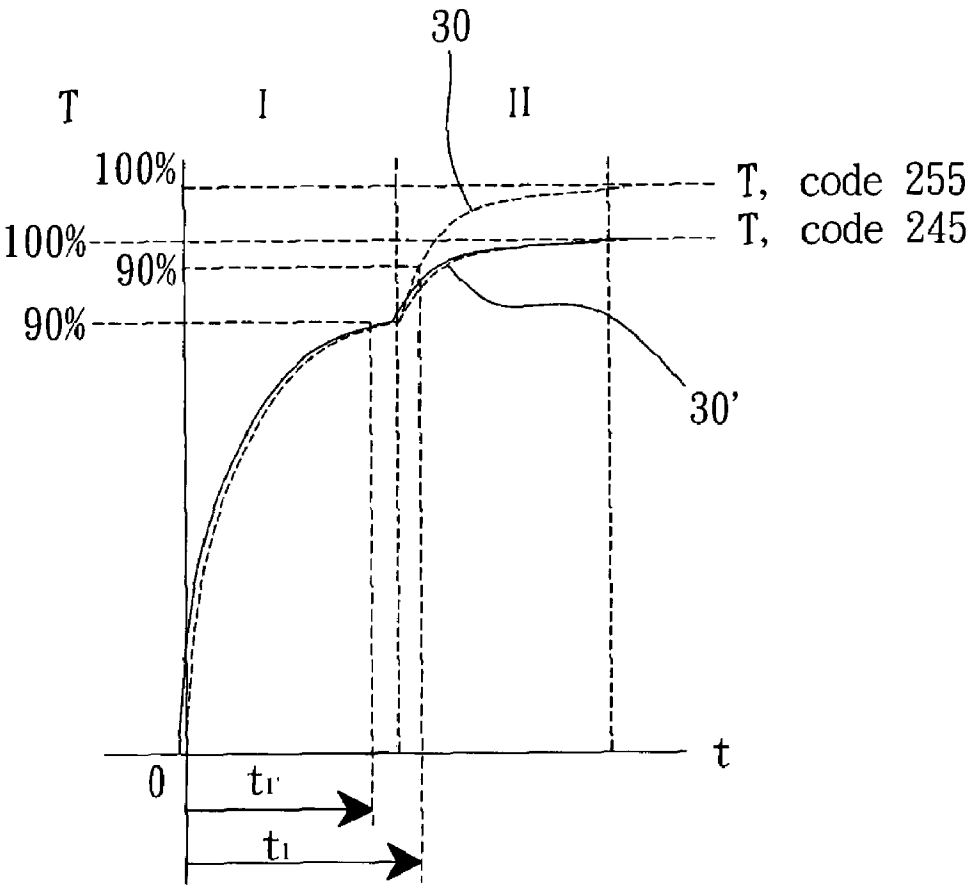
FIG. 5 is a schematic view showing the drive method for the display of the present invention.

However, if the response rate of the liquid crystal molecule is not fast enough, the response time may be greater than the frame time even applied with the overdrive, and the picture quality of the display remains poor. As illustrated in FIG. 5, with the first frame time I, OD code has code 225 to drive pixels, but upon the end of the first frame time I, the luminance has not yet reached 90% of the expected level due to that the response rate of the liquid crystal is too slow. Therefore, its original response time $t_1$ is greater than the first frame time I. If code 255 is used again to drive upon entering into a second frame time II, the luminance will rise again until it reaches 100% of the expected level with its curve as marked "30". Should the grayscale codes within the grayscale presentation range of the image data be mapped to a that within a corresponding range and the latter be used to drive the display without changing the gamma voltage corresponded to the grayscale codes within the grayscale presentation range, either the frame rate control or the dithering technology is used to avoid loss of grayscale codes in the course of applying the code mapping technology.

Taking an 8-bit display with a grayscale presentation range covering codes 0~255 for example, its grayscale presentation range of codes 0~255 correspond to a grayscale range of codes 0~245. That is, a gamma voltage, e.g., 5V of the grayscale code 255 drives the display from all-black picture to all-white picture. After the mapping, grayscale code 255 will become grayscale code 245 with the gamma voltage maintaining at 5V. Therefore, with the first frame time I, an luminance curve 30' of the grayscale code 245 is identical to the luminance curve 30 of the grayscale code 255; however, in relation to 100% luminance of the grayscale code 245, the luminance level reaches 90% within the first frame time I, i.e., an adjusted response time $t_{1'}$ of the grayscale code 245 is shorter than the original response time $t_1$, particularly shorter than the first frame time I of the image data. That will not cause any impacts upon the display of the next frame and therefore provide better and clearer presentation of image.

Figure 6:
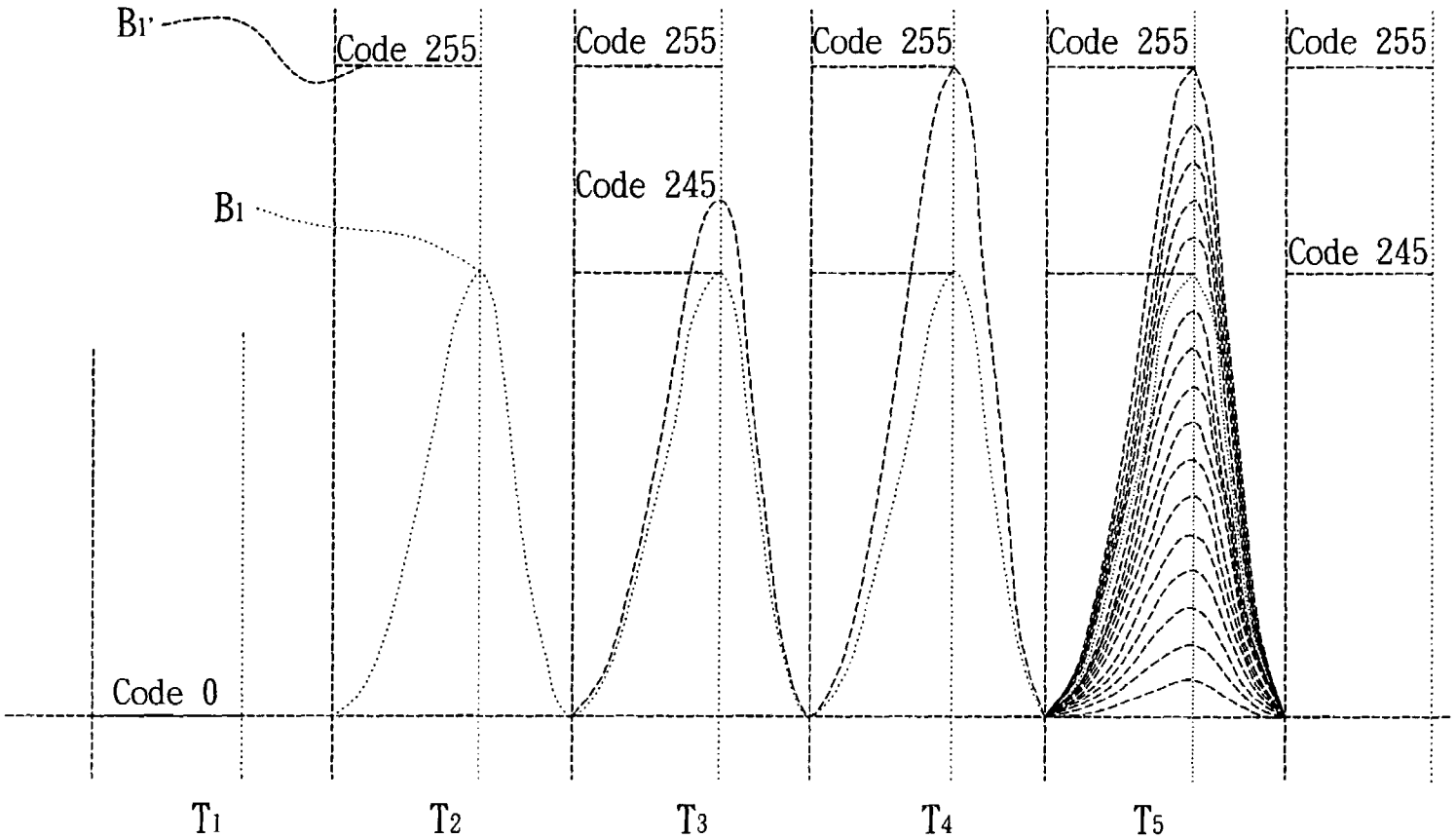
FIG. 6 is a schematic view showing a first preferred embodiment of the present invention.

As illustrated in FIG. 6, the method described above is applied to a first preferred embodiment of the present invention. Wherein, image data are written into a display of grid array pixels, wherein, at least one pixel row time is divided into frame time and black picture time. The image data contains a grayscale code range of multiple continuously distributed grayscale codes. For example, the image data related to In 8-bit image data containing codes 0~255. When the display enters from the first picture time $T_1$ with code 0 into the second picture time $T_2$, the frame time of the first half of the second picture time $T_2$ upon receiving the frame immediately overdrives the pixels. If code 255 is used to drive, the display immediately enters into the black picture time of the second half upon acquiring a fist luminance $B_1$ and receives the data of black picture. The first luminance $B_1$ relates to the maximal luminance the display could reach when subject to the drive by the gamma voltage of the greatest grayscale code and there is still a certain distance between the luminance $B_{1'}$ corresponded to the greatest grayscale code, a phenomenon showing that the response time of that pixel is longer than the frame time. While the display enters into a third picture time $T_3$ through a fifth picture time $T_5$, and OD code 255 remains driving the display, a subsequent luminance $B_2$ will gradually become higher than $B_1$ and approach the luminance $B_{1'}$ of code 245. By applying the display drive method of the present invention, code 255 is mapped to code 245 for 90% of the luminance to be contained in the first luminance $B_1$ without changing the drive voltage. To the display, the response time is always shorter than the frame time disregarding which code is used to drive. To avoid residual or blue picture, the mapping method may be adjusted depending on the layout of the display or the characteristics of liquid crystal molecules. The variation of the luminance is highly flexible as illustrated in those luminance curves illustrated in the fifth picture time $T_5$.

Figure 7:
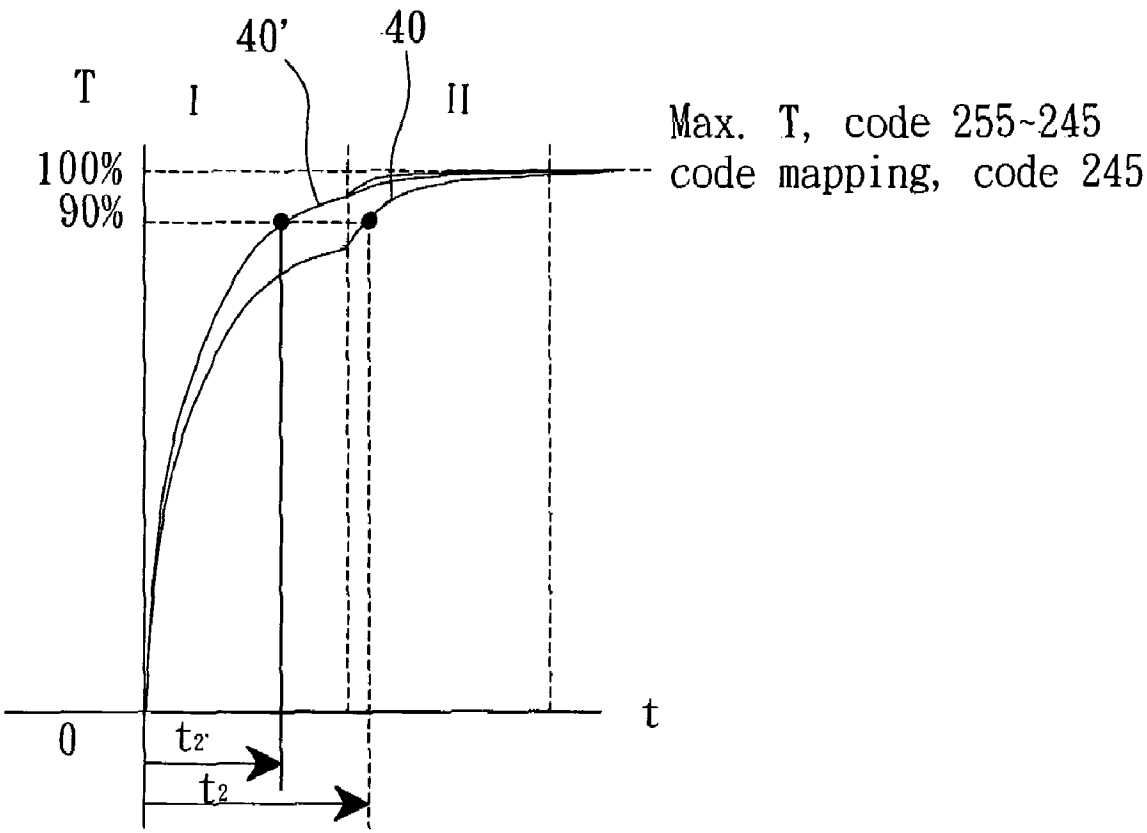
FIG. 7 is another schematic view showing the drive method for the display of the present invention.

FIG. 7 shows another concept about the drive method of the present invention. When the response rate of the liquid crystal is not fast enough, the luminance is prevented from getting any higher when a drive voltage is higher than that of a certain code. For example, even code 255 is used to drive the frames within the range of code 245 through code 255, the luminance displayed within all the frame times is the same with its luminance curve as indicated by curve 40. Its original response time $T_2$ is longer than the first frame time I. When all the grayscale codes from code 245 through code 255 are mapped to code 245 and the gamma voltage is increased, e.g., the code 255 corresponding gamma voltage 5V is increased up to 5.5V to have greater curvature of the luminance curve as marked by 40'; then an adjusted response time $T_{2'}$ is reduced and shorter than the frame time to avoid the residual image.

Figure 8:
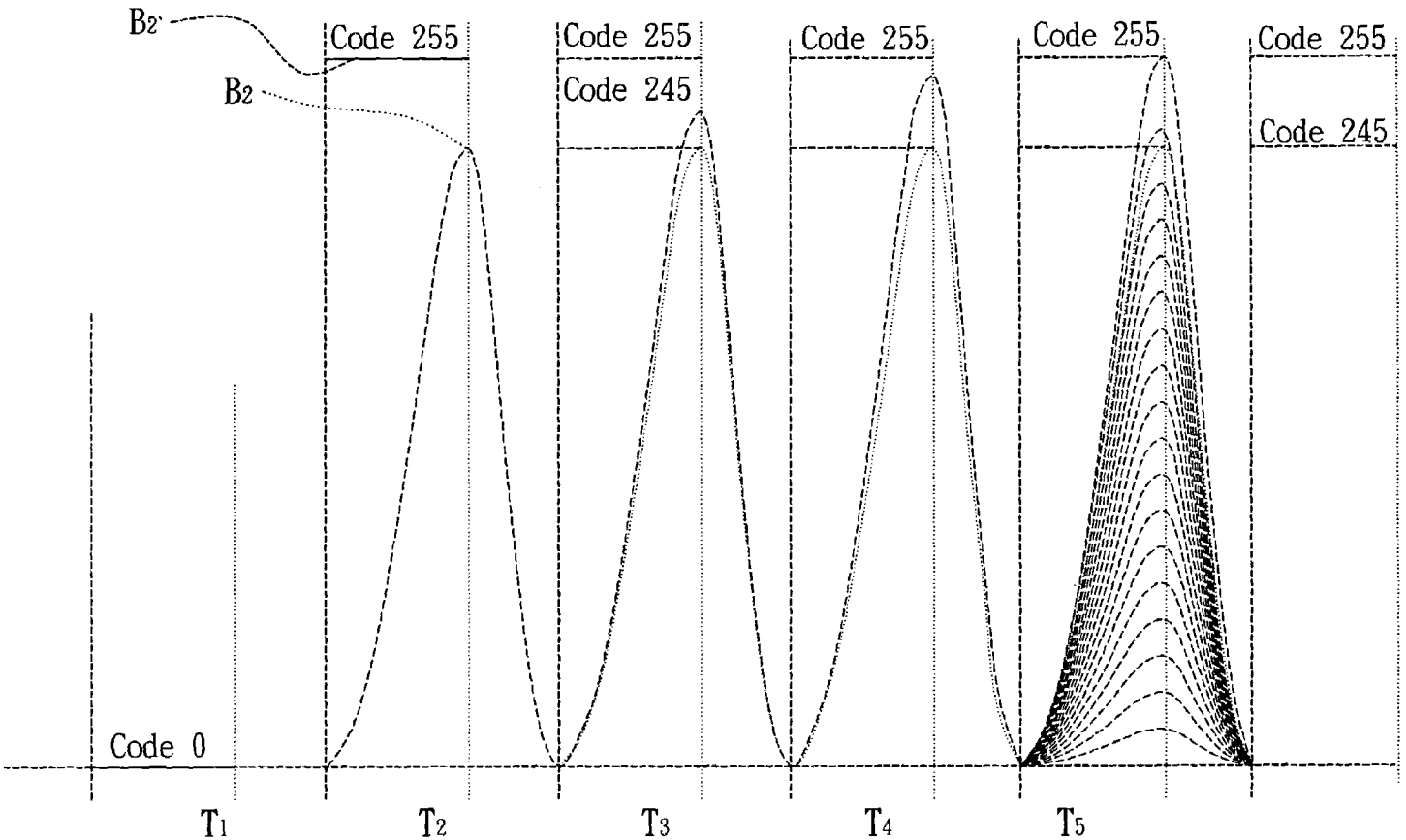
FIG. 8 is a schematic view of a second preferred embodiment of the present invention.

Now referring to FIG. 8 for a second preferred embodiment of the present invention, wherein, an image data are written into a display of grid array pixels, wherein, the time of at least one pixel row is divided into frame time and black picture time. Immediately following the reception of the frames within the first half of the frame time during the second picture time $T_2$ when the display enters from the first picture time $T_1$ with code 0 enters into the second picture time $T_2$, grayscale codes are mapped with code 255 to code 245 and the gamma voltage is increased to drive the display. Wherein, 90% of luminance is contained in the second luminance $B_2$, that is, the adjusted response time becomes shorter than the frame time. Upon acquiring the second luminance $B_2$, the display immediately enters into the black picture time of the second half while receiving data of black picture. The second luminance $B_2$ relates to the highest level of luminance that can be arrived at for the mapped grayscale driven by the increased gamma voltage so to get closer to the expected luminance $B_{2'}$. Since the third picture time $T_3$ through the fifth picture time $T_5$, the display is driven by the mapped code 245. Increased gamma voltage will reduce the loss of luminance. To the display, its response time is always shorter than the frame time thus to effectively avoid the residual or blur image. Similarly, the mapping method may be adjusted depending on the layout of the display or the characteristics of liquid crystal molecules. The variation of the luminance is highly flexible as illustrated in those luminance curves illustrated in the fifth picture time $T_5$. To avoid loss of grayscale code, frame rate control or dithering technology may be used in the course of applying the grayscale mapping technology.

Method to map the grayscale or the adjustment of gamma voltage described above varies depending on customer needs, requirements of picture quality or characteristics of the display and is not to limit the claims made in the present invention. Any modification or variation made by anyone who is familiar with this art shall be deemed as falling within the teaching and scope of the present invention.

Figure 9A:
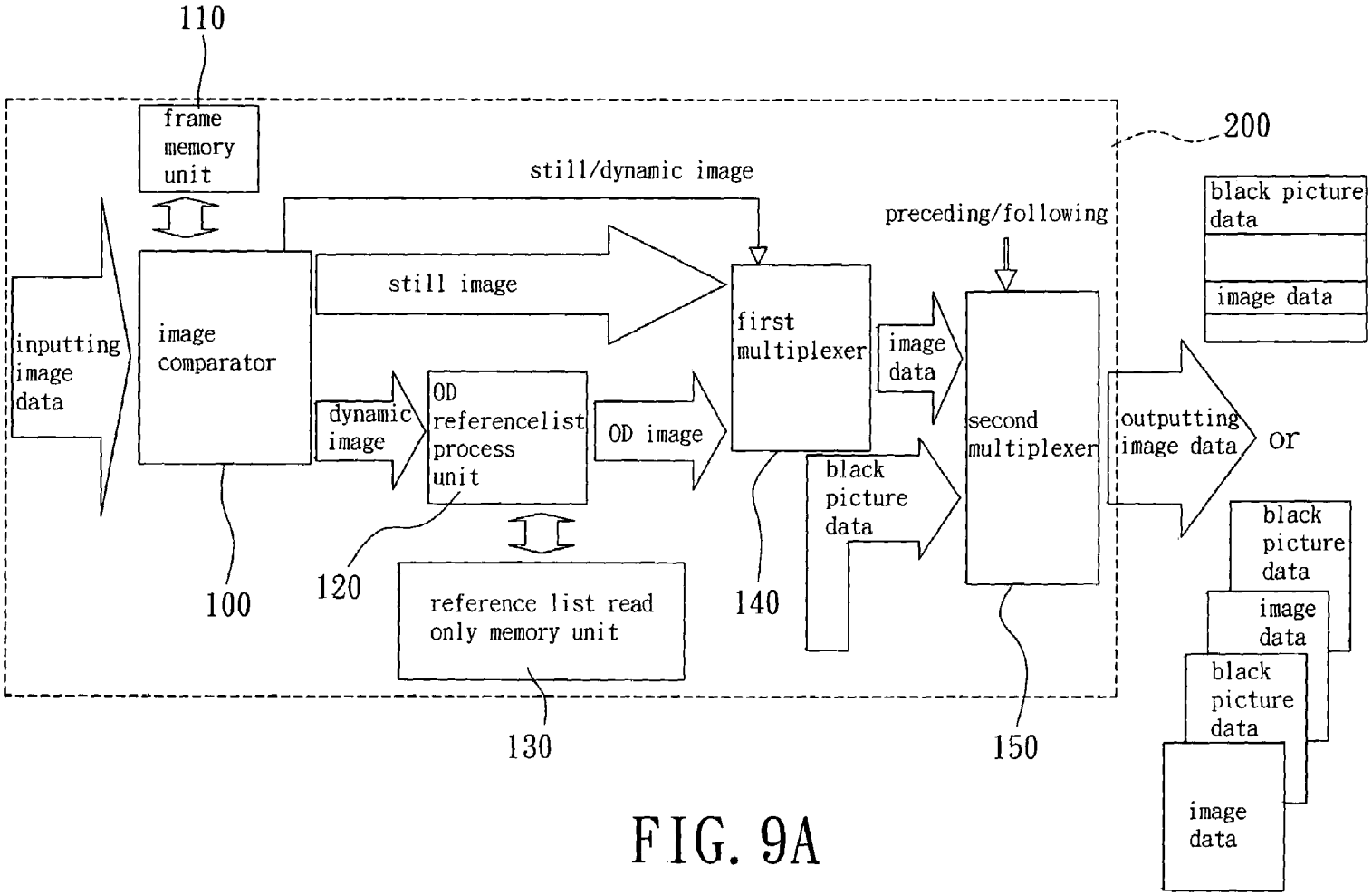
FIG. 9A is a schematic view of a third preferred embodiment of the present invention.

Now referring to FIG. 9A for a third preferred embodiment of the present invention, image data are inputted into the display and the display contains an image comparison module 200 to judge if the image is a still or dynamic picture. The image comparison module 200 contains an image comparator 100 and a frame memory unit 110. The image comparator 100 reads the preceding image stored in the frame memory unit 110 to compare and judge if the frame of the image data inputted relates to still or dynamic image. In case of the former, the still image is directly transmitted to a first multiplexer 140 to pass the data; and in case of the latter, at least one pixel row is overdriven to present the luminance as desired by the current image, i.e., the pixels are accelerated from the black picture of the preceding image data to present the luminance as desired by the current image. For example, an OD reference list process unit 120 reads the gamma voltage corresponded to the grayscale in the reference read only memory unit 130 and transmit the data to a first multiplexer 140 to pass the data and accelerate the output of the overdriven gamma voltage. Wherein, the reference list read only memory unit 130 may be related to an ROM, and the OD reference list process unit 120 may produce the gamma voltage needed by OD by curve fitting and reading the reference list.

The image data are then outputted to a second multiplexer 150, where the image is regulated to become image data or black picture data for the display to undergo flare variation to display in the pseudo impulsive fashion. Those black picture data are simultaneously or synchronously within a display time written into at least one pixel row of the display.

Figure 9B:
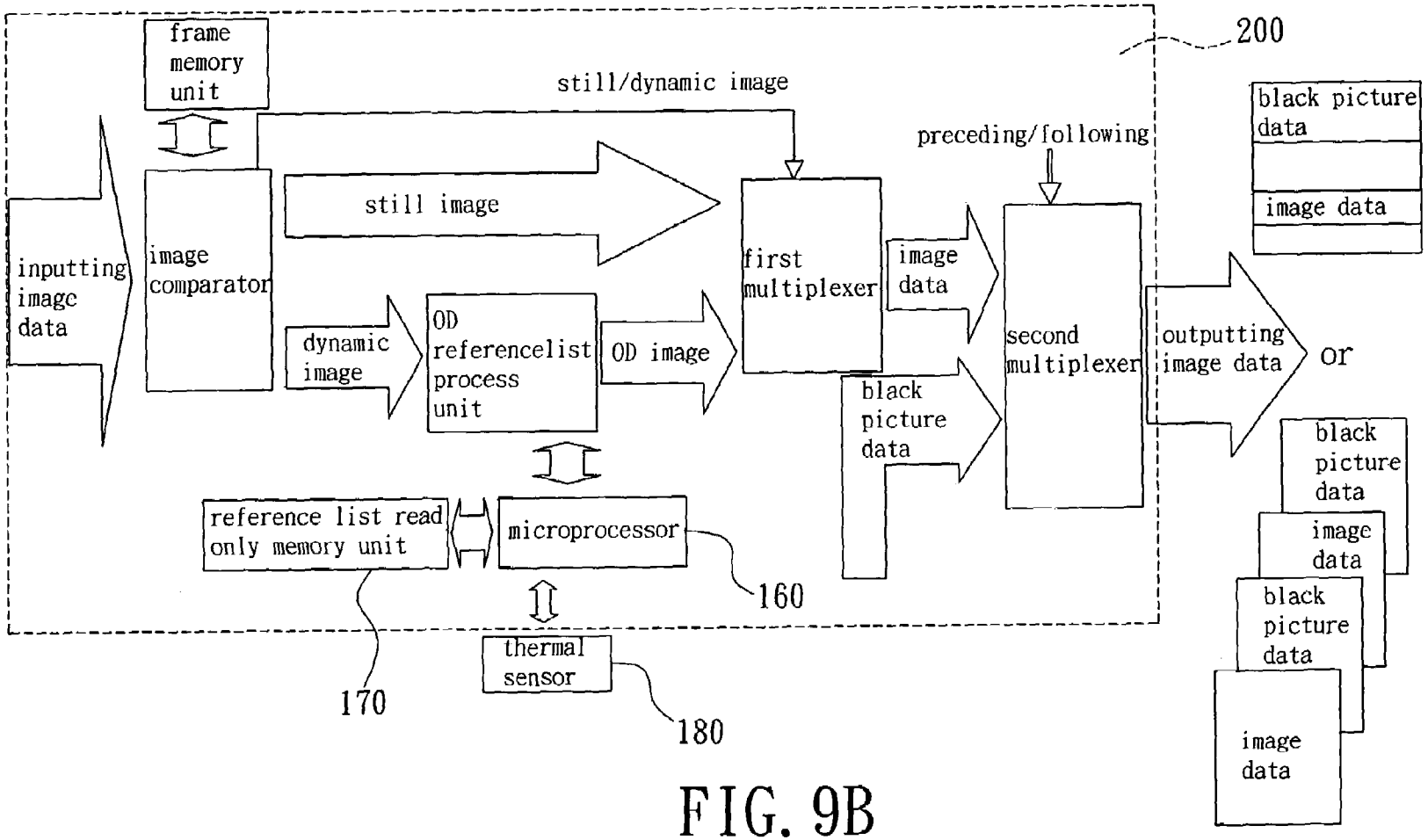
FIG. 9B is a schematic view of a fourth preferred embodiment of the present invention.

As illustrated in FIG. 9B for a fourth preferred embodiment of the present invention, the procedure to overdrive the display of grid array pixels in the fourth preferred embodiment is substantially similar to that in the third preferred embodiment with the difference in that the reference list read only memory unit 130 in the third preferred embodiment is replaced by a microprocessor (Micron, μP) 160. The microprocessor 160 controls a reference list read only unit 170 wherein the reference list is stored and a thermal sensor 180 while providing the grayscale codes and corresponding gamma voltage needed by the OD reference list process unit 120.

Among those four preferred embodiments of the present invention, the image data or the black picture data are written into the pixel rows of the entire display and the display either simultaneously or synchronously within a display time activates two pixel rows at different locations in the display to respectively display the image data and the black picture. That is, the conventional art of inserting black picture into the continuous image picture or controlling the light source to produce flare effects or similar art applied to insertion of black picture is applicable to the drive method of the present invention. The drive method of the present invention is particularly applicable to the display of grid array pixels, such as the process of picture for any type of LCD.

Accordingly, the display panel drive system of the present invention provides the following advantages:

1. The drive method of the present invention effectively corrects the problem of gradually changing luminance produced by the pseudo impulsive display.

2. The drive method of the present invention overcomes the problem of the slow response rate of the liquid crystal molecules in a display by shortening the response time to avoid residual image.

3. The drive method of the present invention for being applicable to the art of insertion of black picture or a display of grid array pixels help promote industrial competition strength by providing a comprehensive range of application.

The prevent invention provides a drive method for a display of grid array pixels and the application for a patent is duly filed accordingly. However, it is to be noted that that the preferred embodiments disclosed in the specification and the accompanying drawings are not limiting the present invention; and that any construction, installation, or characteristics that is same or similar to that of the present invention should fall within the scope of the purposes and claims of the present invention.

The invention claimed is:

1. The drive method for a display of grid array pixels is comprised of the following steps:

writing image data provided with a grayscale code range containing multiple continuously distributed grayscale codes into pixel rows, wherein at least one row is divided into frame time and black picture time; setting up an adjusted range containing multiple grayscale codes; corresponding each grayscale code within the grayscale range to that within the adjusted grayscale range; having the grayscale codes within the adjust range to drive the display without changing a corresponded gamma voltage;

overdriving the pixels to present the luminance desired by the current image; having the responsive time of the pixels shorter than the frame tine in relation to the grayscale code within the corresponding grayscale range;

and writing the black picture data into the pixel row within the black picture time;

inputting image data to an image comparison module of the display to judge if the image is a still or dynamic picture; setting up an adjusted range containing multiple grayscale codes; in case of a dynamic picture, mapping each grayscale code within the grayscale code range to that in the adjusted range; driving the display with the grayscale code within the adjusted range; overdriving at least one pixel row to present the luminance as desired by the current image, and writing simultaneously or synchronously within a display time data of a black picture into at least one pixel row of the display;

wherein the image comparison module contains a frame memory unit to store the preceding image; an image comparator, an OD reference list process unit to process OD drive voltage, and a multiplexer to pass image data; the image comparator receives image input and compares it with the data of the preceding image stored in the frame memory unit to judge if the current image relates to a still or a dynamic picture.

2. The drive method for a display of grid array pixels of claim 1, wherein a mapping technique is used.

3. The drive method for a display of grid array pixels of claim 1, wherein the OD reference list process unit processes the drive voltage in the fashion of curve fitting.

4. The drive method for a display of grid array pixels of claim 1, wherein the OD reference list process unit relates to a reference list read only unit that reads grayscale codes for the display to overdrive presentation of the current image.

5. The drive method for a display of grid array pixels of claim 1, wherein the OD reference list process unit related to a reference list module to provide grayscale code needed in overdrive contains a reference read only unit to store the reference list, a thermal sensor, and a microprocessor to control the reference list read only unit and the thermal sensor.

6. The drive method for a display of grid array pixels of claim 1, wherein the image data or black picture data are written into rows of pixels of the entire display.

7. The drive method for a display of grid array pixels of claim 1, wherein the display simultaneously or synchronously within a display time activates two rows of pixel at different locations in the display to respectively display image data and black picture.

* * * * *